US008597071B2

(12) United States Patent
Shweky et al.

(10) Patent No.: US 8,597,071 B2
(45) Date of Patent: Dec. 3, 2013

(54) BRASSERIE WITH SCENTED MEMBER AND DISPENSER THEREFORE

(76) Inventors: Michael Shweky, Oakhurst, NJ (US); Robert Laniado, Oakhurst, NJ (US)

( * ) Notice: Subject to any disclaimer, the term of this patent is extended or adjusted under 35 U.S.C. 154(b) by 1304 days.

(21) Appl. No.: 12/192,709

(22) Filed: Aug. 15, 2008

(65) Prior Publication Data

US 2009/0081925 A1 Mar. 26, 2009

Related U.S. Application Data

(60) Provisional application No. 60/975,251, filed on Sep. 26, 2007.

(51) Int. Cl.
*A41C 3/00* (2006.01)

(52) U.S. Cl.
USPC ..... 450/89; 450/1; 2/247; 2/251

(58) Field of Classification Search
USPC ..... 450/89, 1; 2/247, 249, 250–252
See application file for complete search history.

(56) References Cited

U.S. PATENT DOCUMENTS

| | | | | |
|---|---|---|---|---|
| 2,436,430 | A * | 2/1948 | Hart | 450/3 |
| 2,492,862 | A * | 12/1949 | Harvey | 450/89 |
| 2,503,847 | A * | 4/1950 | Shanahan | 450/89 |
| 2,610,325 | A * | 9/1952 | Schlussel | 450/89 |
| 2,624,881 | A * | 1/1953 | Lee | 450/89 |
| 3,078,852 | A * | 2/1963 | Stapleton | 450/89 |
| 3,711,011 | A | 1/1973 | Kugler | |
| 4,666,462 | A * | 5/1987 | Martin | 48/197 R |
| 5,809,577 | A | 9/1998 | Getz | |
| 6,089,953 | A | 7/2000 | Chen | |
| 6,102,773 | A | 8/2000 | Wu | |
| 6,176,761 | B1 * | 1/2001 | Underhill | 450/89 |
| 6,517,410 | B1 * | 2/2003 | Underhill | 450/1 |
| 7,364,491 | B2 * | 4/2008 | Updyke | 450/89 |
| 2004/0113418 | A1 | 6/2004 | Bullen | |
| 2007/0104902 | A1 | 5/2007 | Popplewell et al. | |

FOREIGN PATENT DOCUMENTS

WO WO 03/052033 6/2003

OTHER PUBLICATIONS

International Search Report and Written Opinion of the International Searching Authority for PCT/US08/70433 dated Feb. 26, 2009.

* cited by examiner

*Primary Examiner* — Gloria Hale
(74) *Attorney, Agent, or Firm* — Leason Ellis LLP

(57) ABSTRACT

A fragrant brasserie according to one embodiment includes a body portion having a pair of cups, a pair of side straps that engage one another for securely attaching the brasserie to a person's body, and a pair of shoulder straps connected between the cups and the side straps. The body portion has a front section located between the pair of cups that includes an opening leading into an interior compartment. The brasserie also includes a fragrant article that is removably disposed within the interior compartment. The fragrant article has a fragrance associated therewith that provides a pleasant scent that can be experienced over a period of time. The fragrant article is formed of a material that absorbs a liquid and includes a liquid fragrance that impregnates the material so as to provide a pleasant smelling experience when the fragrant article is worn with the brasserie.

16 Claims, 5 Drawing Sheets

BRASSERIE WITH SCENTED MEMBER AND DISPENSER THEREFORE

CROSS REFERENCE TO RELATED APPLICATION

The present application claims the benefit of U.S. provisional patent application Ser. No. 60/975,251, filed Sep. 26, 2007, which is hereby incorporated by reference in its entirety.

TECHNICAL FIELD

The present invention relates to a brasserie and in particular, to a brasserie that incorporates a pleasing fragrant smell and to retail packaging and promotional material containing the same.

BACKGROUND

A brasserie (bra) is conventionally used by women as a close-fitting support for their breasts. Conventional bras generally are made of two brasserie cups with side straps having a back-hook closure or a front-hook closure to securely wear the bra to the body. Two shoulder straps are connected between each pair of brasserie cups and the side strap so that the bra is well worn to the body.

As with other close-fitting articles of clothing, under certain conditions, especially warm weather, the wearer of the article may perspire and produce an unpleasant smell and therefore, wearing a fragrance can mask such smell. Also, it is commonplace for a woman to wear perfume to work and to social engagements. It is therefore desirable to provide a product that has a pleasing smell and is designed to be worn with a bra.

SUMMARY

A fragrant brasserie according to one embodiment includes a body portion having a pair of cups, a pair of side straps that engage one another for securely attaching the brasserie to a person's body, and a pair of shoulder straps connected between the cups and the side straps. The body portion has a front section located between the pair of cups that includes an opening leading into an interior compartment. The brasserie also includes a fragrant article that is removably disposed within the interior compartment. The fragrant article has a fragrance associated therewith that provides a pleasant scent that can be experienced over a period of time. The fragrant article is formed of a material that absorbs a liquid and includes a liquid fragrance that impregnates the material so as to provide a pleasant smelling experience when the fragrant article is worn with the brasserie.

In another embodiment, an article of intimate apparel includes a brasserie having a body portion having a pair of cups, a pair of side straps that engage one another for securely attaching the brasserie to a person's body, and a pair of shoulder straps connected between the cups and the side straps. The body portion has a front section located between the pair of cups that includes an opening leading into an interior compartment. The article of intimate apparel also has a pouch that is removably attached to the brasserie and at least one fragrant article contained within the pouch in a sealed package that contains odiferous molecules. The fragrant article is configured so that is can be removably disposed within the interior compartment. The fragrant article has a fragrance associated therewith, defined by the odiferous molecules, that provides a pleasant scent that can be experienced over a period of time.

These and other aspects, features and advantages shall be apparent from the accompanying Drawings and description of certain embodiments of the invention.

DETAILED DESCRIPTION OF CERTAIN EMBODIMENTS OF THE INVENTION

Figure 1:
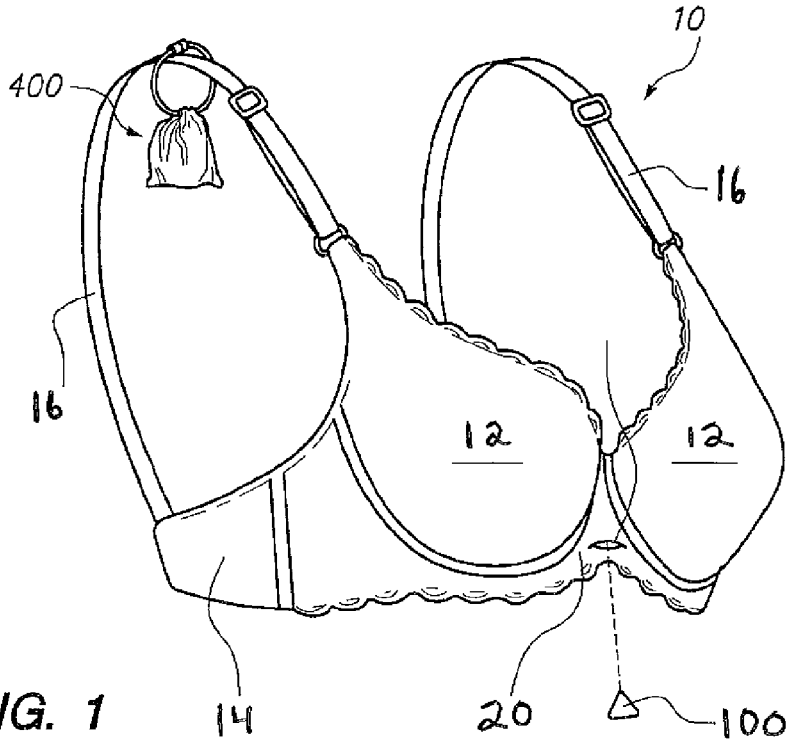
FIG. 1 is a perspective view of a brasserie incorporating a fragrant member according to the present invention.

FIG. 1 shows a brasserie (bra) 10 having a pair of cups 12 with side straps 14 having a back-hook closure. Two shoulder straps 16 are connected between each pair of cups 12 and the side straps 14 so that the bra 10 is well worn to the body. A front body portion 20 is provided between the cups 12 in the front of the bra 10. The front body portion 20 has a slot or pocket 30 formed therein for receiving and retailing an object, as in a sliding manner. The slot or pocket 30 forms an entrance into an interior compartment for receiving a fragrant member (scented member) 100 in such a way that the fragrant member 100 is securely held within the interior compartment during normal use of the bra 10.

FIG. 1 shows a fragrant member 100 in accordance with one embodiment of the present invention. In the illustrated embodiment, the fragrant member 100 has a triangular shape with rounded edges and is configured so that one point of the member 100 can be inserted into the slot or pocket 30. The fragrant member 100 is constructed so that it has a specific fragrance or scent associated therewith and therefore, when the fragrant member 100 is inserted into the interior compartment or are otherwise carried by the article of clothing, the wearer experiences a pleasing fragrant smell over an extended period of time. The fragrant member 100 can either act as a substitute to the conventional spraying of perfume on the skin or can supplement an earlier perfume application. In other words, the fragrant member 100 can be inserted into the slot or pocket 20 several hours after the initial application of the perfume to the wearer's skin.

The fragrant member 100 can be formed of a number of different materials so long as the materials are capable of maintaining the fragrant smell over a period of time. For example, the fragrant member 100 can be formed of a plastic material (which can be scented); a woven hard fabric material or a thick paper stock material (e.g., cardboard).

The fragrant member 100 is shaped and dimensioned so that they can be worn within the front body portion 20 of the bra 10. For example the fragrant member 100 can be sized and dimensioned to be received into pocket 20 and a portion of the member 100 protrudes from the pocket 20; however, it does not extend beyond the confines of the front body portion 20 and does not interfere with wearing the bra 10 in a comfortable manner.

Figures 2, 3, 4:
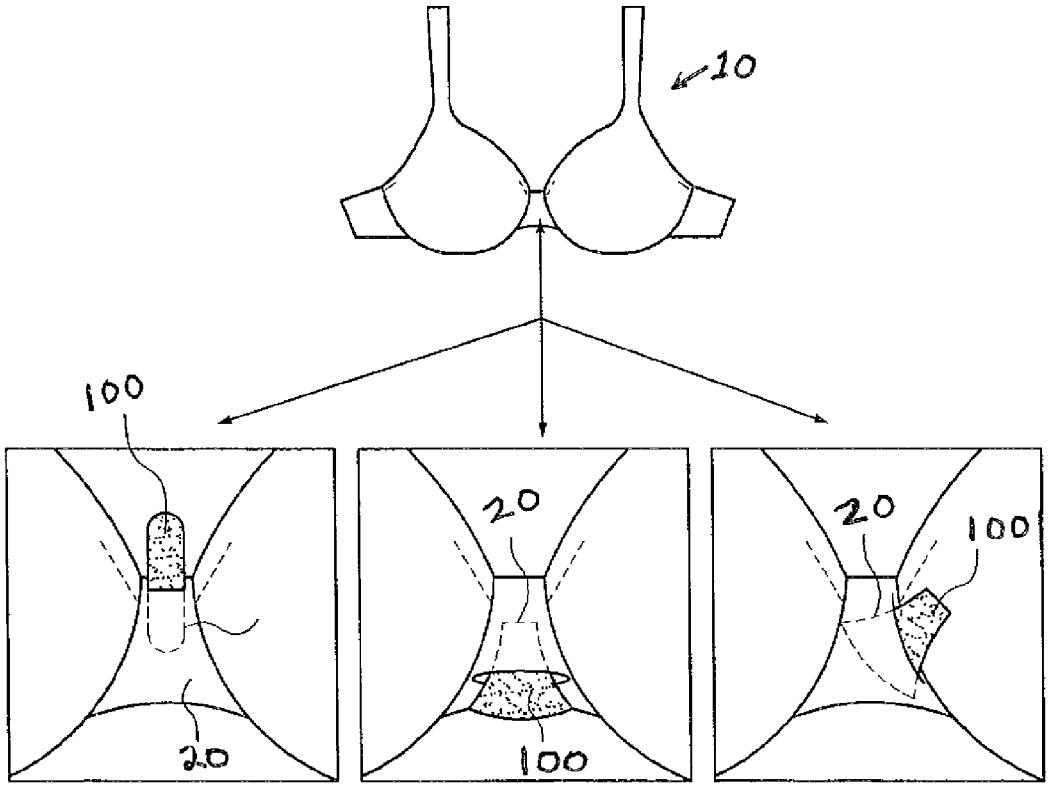
FIG. 2 is an enlarged view of a front body portion of the brasserie for receiving in a top insert manner and holding a fragrant member having a first shape.
FIG. 3 is an enlarged view of a front body portion of the brasserie for receiving in a bottom insert manner and holding a fragrant member having a second shape.
FIG. 4 is an enlarged view of a front body portion of the brasserie for receiving in a side insert manner and holding the fragrant member.
Figure 5:
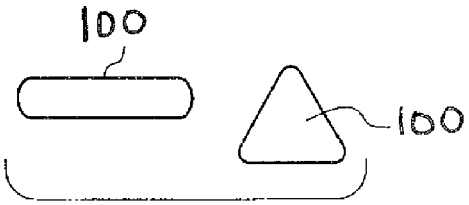
FIG. 5 is a top plan view of two different fragrant members for use with the brasserie according to one embodiment.

FIG. 2 shows the fragrant member 100 having an elongated shaped with rounded ends and also shows a top insert method of securing the fragrant member 100 to the bra 10. In this embodiment, the slot 30 opens along the top of the pocket (interior compartment) so that the fragrant member 100 is inserted from the top into the interior compartment. Once again, the top of the fragrant member 100 should not extend beyond the front body portion 100 and come into contact with the breasts of the wearer. FIG. 3 shows the insert 100 having a triangular shape with rounded edges as described above and also shows a bottom insert method of securing the fragrant member 100 to the bra 10. The user inserts the fragrant member 100 from the bottom and directs the fragrant member 100 up into the interior compartment. FIG. 4 shows a side insert method of attaching and securing the fragrant member 100 to the front body portion 20 and in this design, the slot 30 is located along the side of the portion 20 closer to one of the cups 12. Once again, when the fragrant member 100 is fully inserted it should not interfere with wearing the bra 10 in a comfortable manner.

Figure 6:
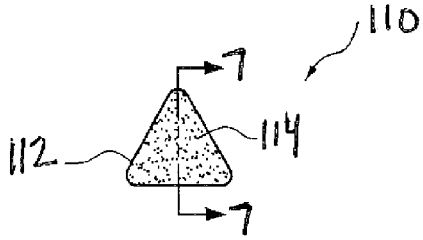
FIG. 6 is a top plan view of a fragrant member, according to a second embodiment, that includes a coating of fragrant material.
Figure 7:
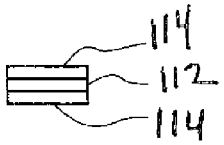
FIG. 7 is a cross-sectional view taken along the line 7-7 of FIG. 6.

FIG. 6 is top plan view of a fragrant member 110 according to a second embodiment of the present invention and FIG. 7 is a cross-sectional view of the fragrant member 110. The fragrant member 110 includes a body 112 with opposing first and second surfaces or faces. The fragrant member 110 includes a scented coating 114 that is disposed over at least one of the first and second surfaces. The scented coating 114 is formed of a material that results in a substantially hard coated layer 114 being formed on the body 112. The coating 114 is therefore formed so that it cannot be easily removed, such as by peeling the coating 114 off the body 112. In addition, the material used to form the coating 114 must be able to absorb and retain the fragrance/scent so that it can be released over a period of time. For example, the coating 114 can be formed of a porous material.

Figure 8:
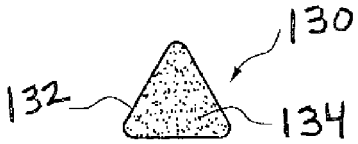
FIG. 8 is a top plan view of a fragrant member, according to a third embodiment, that includes a scented adhesive.

FIG. 8 is top plan view of a fragrant member 130 according to a third embodiment of the present invention. The fragrant member 130 includes a body 132 with opposing first and second surfaces or faces. The fragrant member 130 includes a scented adhesive 134 that is disposed over at least one of the first and second surfaces. For example, the scented adhesive 134 can be in the form of a scented glue or glue-like substance. The scented adhesive 134 can be applied in different locations (spots) along one or more surfaces of the body 132 or can be disposed as a layer over one surface of the body 132. As with all of the embodiments, the adhesive 134 is capable of retaining and releasing the fragrance over a period of time.

Figure 9:
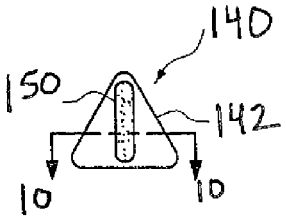
FIG. 9 is a top plan view of a fragrant member, according to a fourth embodiment, that includes a rupturable packet of a liquid fragrance.
Figure 10:
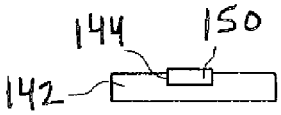
FIG. 10 is a cross-sectional view taken along the line 10-10 of FIG. 9.

FIG. 9 is top plan view of a fragrant member 140 according to a fourth embodiment of the present invention and FIG. 10 is a cross-sectional view thereof. The fragrant member 140 includes a body 142 with opposing first and second surfaces or faces. The fragrant member 140 includes a fragrance capsule or packet 150 that is incorporated into the body 142. The fragrance capsule 150 is formed of a rupturable material, such as a thin plastic structure, that is easily ruptured by flexing the fragrant member 140. For example, one of the surfaces of the body 142 can have a recess (recessed compartment) 144 that receives and holds the fragrance capsule 150. When the user desires to release the fragrance and impregnate the fragrant member 140 with fragrance, the user simply either flexes the fragrant member 140 a sufficient degree to cause the capsule 150 to rupture or the user simply directly ruptures the capsule 150. Upon rupturing of the capsule 150, the fragrance contained therein is released over the fragrant member 140 where it is absorbed resulting in impregnation of the fragrant member 140 with the fragrance.

Figure 11:
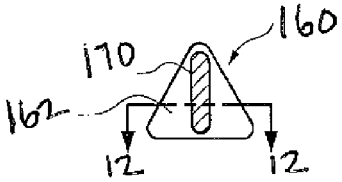
FIG. 11 is a top plan view of a fragrant member, according to a fifth embodiment, that includes an insert formed of a fragrant material.
Figure 12:
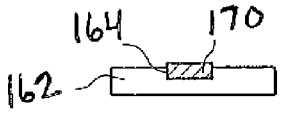
FIG. 12 is a cross-sectional view taken along the line 12-12 of FIG. 11.

FIG. 11 is top plan view of a fragrant member 160 according to a fifth embodiment of the present invention and FIG. 12 is a cross-sectional view thereof. The fragrant member 160 includes a body 162 with opposing first and second surfaces or faces. The fragrant member 160 includes at least one recessed compartment (indented portion) 164 that is formed in one or more of the first and second surfaces or faces. An insert 170 that is formed of a scented material is disposed within the recessed compartment 164. In this manner, the body 162 can be reusable in that once the fragrant smell of one insert 170 fades over time, the user can simply remove the insert 170 and then replace it with another insert 170 that can have the same fragrance or it can have another fragrant smell.

Figure 13:
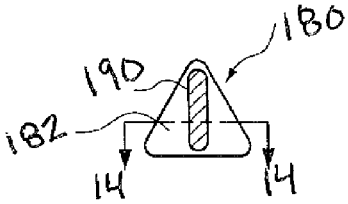
FIG. 13 is top plan view of a fragrant member, according to a sixth embodiment, that includes a layer of fragrant material.
Figure 14:
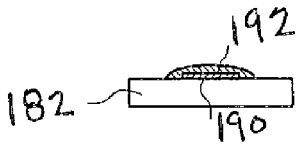
FIG. 14 is a cross-sectional view taken along the line 14-14 of FIG. 13.

FIG. 13 is top plan view of a fragrant member 180 according to a sixth embodiment of the present invention and FIG. 14 is a cross-sectional view thereof. The fragrant member 180 includes a body 182 with opposing first and second surfaces or faces. The fragrant member 180 incorporates a scented vaporizing mechanism 190 which can be in the form of a material (layer of material) that contains odiferous molecules that are vaporized from a solid state under certain conditions, such as exposure to atmosphere, heat, etc. For example, the material 190 can be covered with a release or cover layer 192 that can easily be peeled off so as to cause the scented material 190 to be exposed to atmosphere. The edges of the cover 192 can include an adhesive compound and the cover 192 is formed of a material that seals the freshness and scent of the material 190 until removal of the cover 192 as by peeling the cover 192 from the body 182, thereby exposing the material 190.

Figure 15:
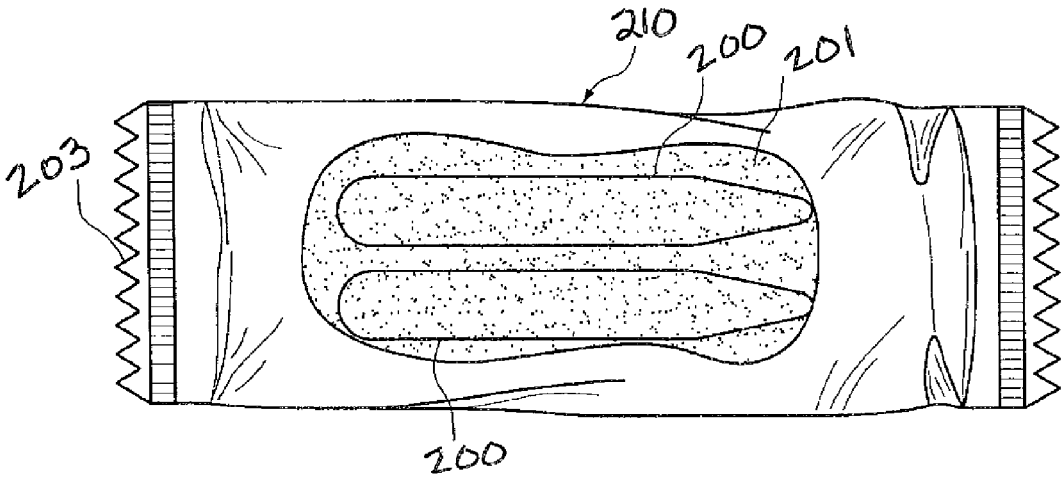
FIG. 15 is a top plan view, partially broken away, illustrating a package of fragrant members according to one embodiment.

FIG. 15 is a top plan view, partially broken away, of a fragrant member 200 and packaging according to one embodiment. In this embodiment, one or more pairs of fragrant members 200 are sealed in a package 210. The package 210 is formed of a material that can seal liquid 201 within its interior, while at the same time be robust enough to withstand being carried in a bag, pocketbook, etc. For example, the package 210 can be formed of a flexible foil material or thin plastic material. The ends of the package 210 can be perforated or jagged, as shown at 203, in order to assist the user in opening the package 210 and removing the scented collar stays 200.

The fragrance/scent is in the form of a liquid perfume 201 that is injected into the interior of the package 210 so that the liquid fragrance contacts and baths the fragrant member 200. The amount of liquid will be sufficient to contact at least a substantial surface area of the fragrant member 200 but not be excessive so that once the package 210 is open, liquid fragrance runs out of the package over the user.

Preferably, the packaging 210 includes a label (not shown) identifying the scent, e.g., identification of the brand of perfume that is contained in the package 210 (e.g., Chanel or Armani). This permits the user to easily choose the desired fragrance from amongst a number of packages 210 that could contain different scents. It will be appreciated that a number of individual packages 210 can be arranged and marketed in a single box. The box can contain multiple packages 210 of a single fragrance or it can be a "sampler" box in that it contains a number of packages 210 that contain different fragrances. For example, if one clothing company or cosmetic company has a line of different perfumes, the company can market all of their different perfumes/colognes by including within the box at least one package of fragrant members impregnated with each perfume. This serves as an excellent promotion means in that the fragrant members serve as a sampler for the company's perfumes with the goal being that once the wearer has a pleasant experience with the fragrant members, the user will purchase a bottle of the perfume.

The fragrant members 200 are formed of a material, such as thick paper stock, that can absorb the liquid fragrance that immerses the fragrant members 200 inside the package 210. Conventional packaging and package sealing technology is used in that the fragrant members 200 can be inserted into an open end of the package 210, a predetermined amount of fragrance is then added and then the open end is sealed.

Figure 18:
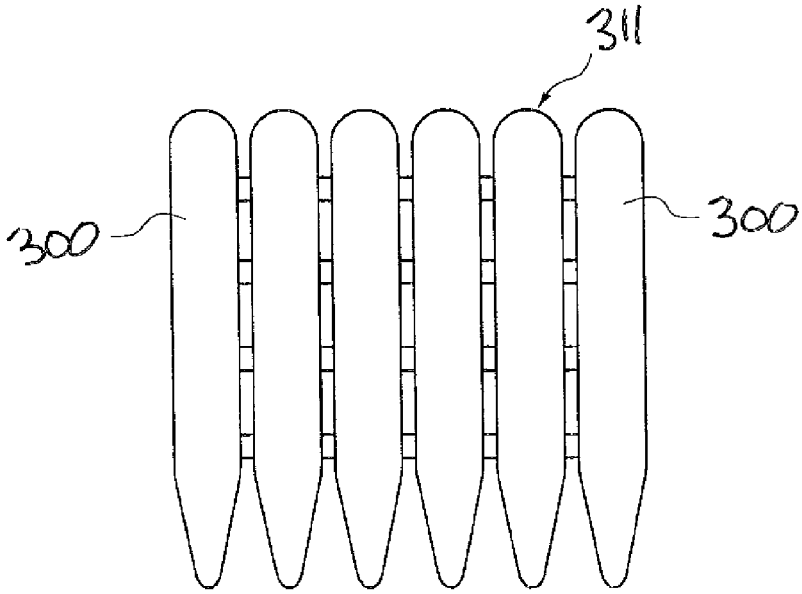
FIG. 18 is a top plan view of a bandolier of fragrant members.
Figure 16:
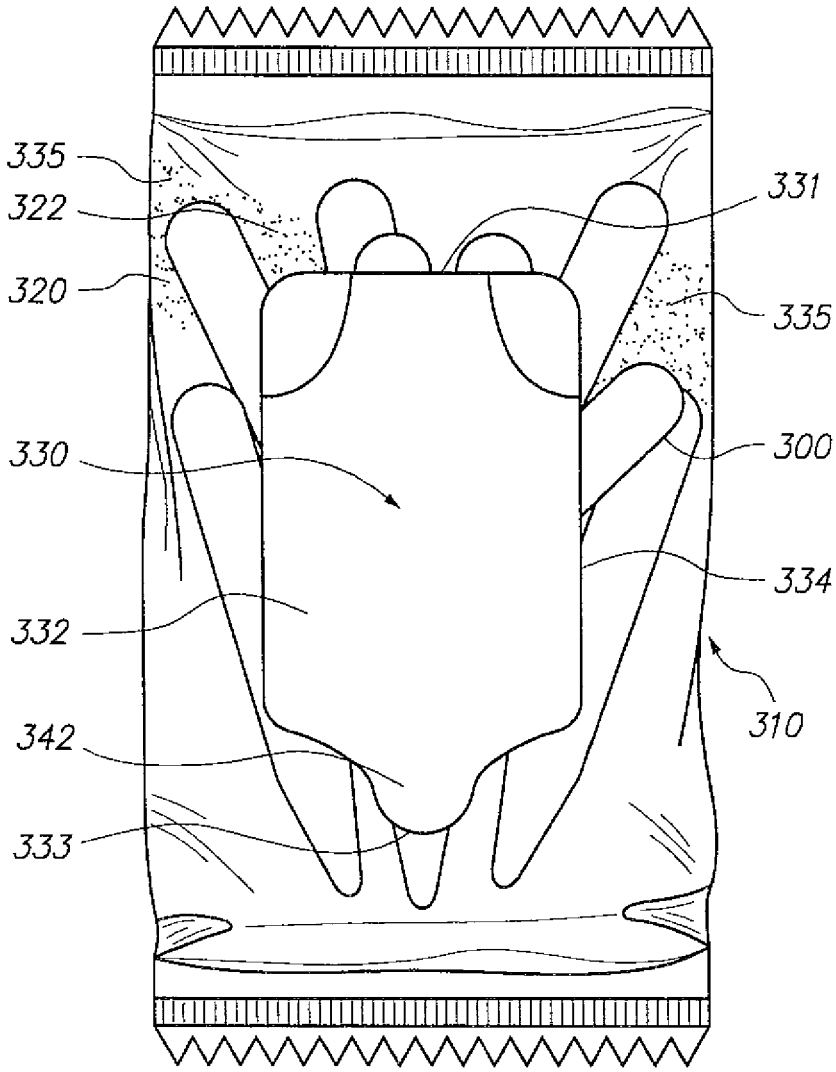
FIG. 16 is a top plan view of a package of fragrant members according to another embodiment in a sealed position.
Figure 17:
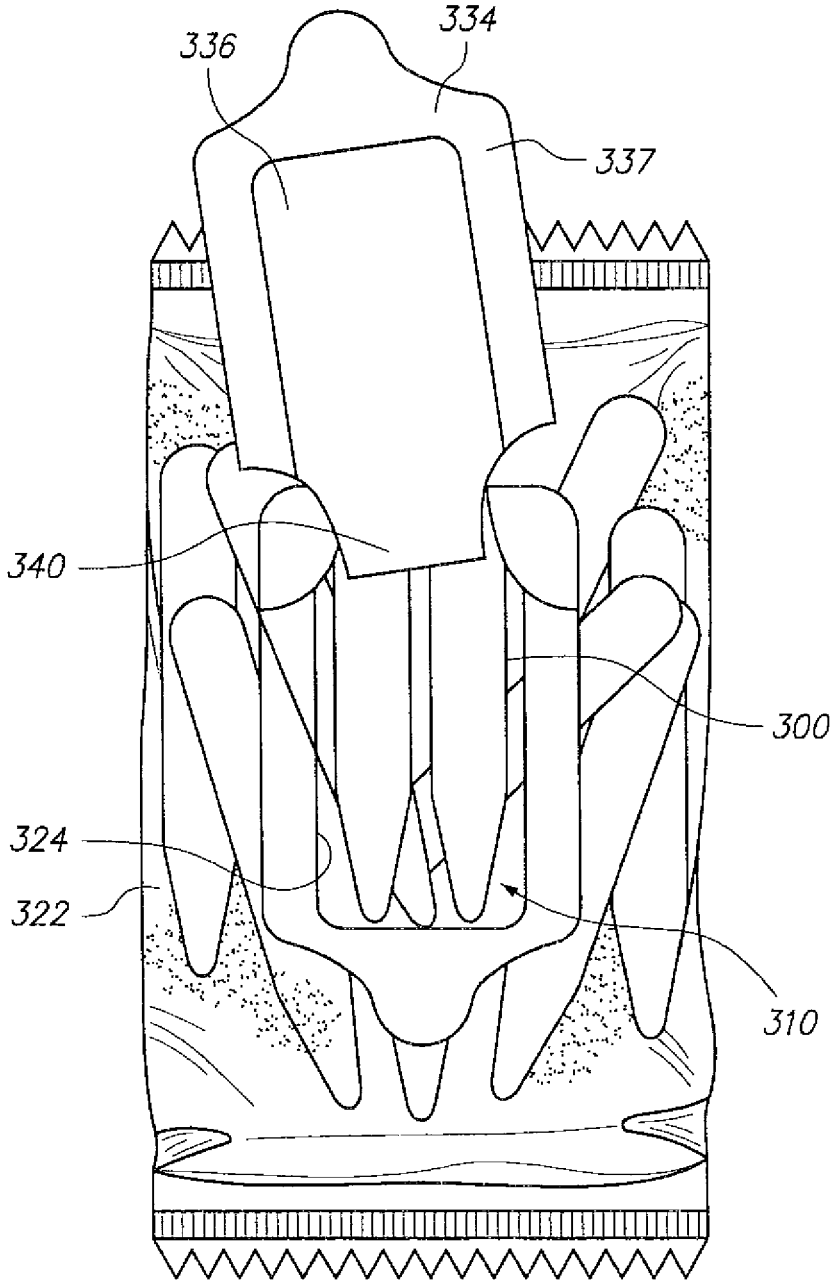
FIG. 17 is a top plan view of the package of FIG. 16 in an open position.

FIGS. 16-17 illustrate a fragrant member package and delivery system according to another embodiment. More specifically, in this embodiment, a plurality of fragrant members 300 are disposed and sealed within a package 310. The fragrant members 300 can be detached and separate from one another as shown in FIGS. 16 and 17 or in another embodiment shown in FIG. 18, the fragrant members 300 are in the form of a bandolier structure 311 (fragrant members 300 detachably connected in series).

In this embodiment, the package 310 is meant to be reusable in that it includes a main package body 320 made of a material that seals the liquid fragrance therein and in contact with the fragrant members 300. One face or surface 322 of the package body 320 includes an opening 324 formed therein that permits access to the interior of the package 310. The opening 324 is sized and shaped so that the fragrant members 300 can be freely removed from the interior of the package 310 through the opening 324. In the illustrated embodiment, the opening 324 has an oblong or rectangular shape.

The package 310 is reusable due to the inclusion of a reusable seal member or label 330. The label 330 has a first side 332 and an opposite second side 334 and has dimensions greater than the opening 324 so that when the label 330 is attached to the surface 322, the entire opening 324 is covered and sealed by the label 330. The first side 332 of the label 330 is the side that faces out and is visible to the user. This first side 332 thus contains indicia, such as the name of the fragrance and other brand and marketing information. As shown in FIG. 17, the other side 334 of the label 330 is the side that seals the opening 324. This side 334 includes a first section 336 that has complementary shape to the opening 324 and is designed to be placed over the opening 324 when the label 330 is sealingly, yet detachably, attached to the surface 322. The first section 336 can be formed of a thin layer of foil, while the remaining sections 337 of the label 330 can be formed of a thin plastic material since foil tends to create a better seal with the package body 320. The foil material used for the first section 336 can be the same or a similar material as the material that is used to form the package 310.

The second section 337 that surrounds the first section 336 includes a layer of adhesive of the type that permits the label 330 to be reused, thereby permitting the package 310 to be resealed. In order words, the adhesive layer that surrounds at least a portion of the first section 336 allows the label 330 to be lifted for exposing the opening 324 and accessing the fragrant members 300 and then resealed against the surface 322 so as to prevent any of the liquid fragrance from leaking from opening 324 and to ensure the fragrant members 300 remain immersed in a sufficient amount of liquid fragrance 335.

Preferably, the label 330 include a fixed end 331 that is securely attached or bonded to the surface 322 in a manner in which the lifting of the other end 333 of the label 330 does not cause the fixed end 331 to separate from the surface 322. Thus, the fixed end 331 is permanently attached to the surface 322. A hinge element 340 is provided at or proximate the fixed end 331 to permit the lifting of the label 330 to expose the opening 324. To assist the user, the other end 333 can include a peel back portion or peel back tab 342 that the user grasps in order to easily lift and break the seal between the label 330 and surface 322. The use of fixed end 331 and hinge element 340 also ensures that the first section 336 (foil) properly aligns with and covers the opening 324.

By providing a bandolier of fragrant members 300, the user simply can open the package 310 by lifting the pull tab 333 to expose opening 324 and then retrieving a preselected number of fragrant members 300. In the case of when the fragrant members 300 are in the bandolier form 311 of FIG. 16, the user simply separates the fragrant members 300 from the bandolier structure 311 outside of the opening 324 and then places the unused ones back into the package 310. After the fragrant members 300 have been removed, the package 310 is resealed with label 330 and the remaining fragrant members 300 remain fresh and fragrant in the sealed package 310.

In another embodiment, the fragrant members can be incorporated into a storage bag or pouch 400 that is constructed to hold a plurality of fragrant members 200, such as package 210 containing a number of fragrant members. The construction of the pouch 400 is not critical so long as it can be easily attached to the bra 10, such as to one strap 16 thereof, and likewise be easily removed therefrom. For example, the pouch 400 can contain a draw string that tightens (cinches) the open end of the pouch. The pouch 400 can then be looped around and secured to the strap 16 using the draw string. The pouch 400 is thus extremely suitable for travel and can easily be placed into a purse or handbag when the bra 10 is being used. Instead of having a draw string, the pouch can contain a buttoned flap that closes the open end of the pouch or other constructions can be used.

It will be appreciated that the combination of the pouch 400 and the bra 10 provides an excellent promotion tool, as well, as provides a useful, convenient product for purchase by a consumer. For example, a seller or store that specializes in selling intimate apparel can team up with a partner that specializes in fragrances (perfumes) to offer a combined product or the seller can offer their own fragrances as part of an attractive package to the consumer. In addition, the pouch 400 is intended to be reused since the user call simply place additional packaged fragrant members 100 therein to replenish their supply. The pouch 400 also provides advertising space for the manufacturer of a particular line of fragrances.

While the invention has been described in connection with certain embodiments thereof, the invention is capable of being practiced in other forms and using other materials and structures. Accordingly, the invention is defined by the recitations in the claims appended hereto and equivalents thereof.

What is claimed is:

1. A fragrant brassiere comprising:

a body portion having a pair of cups, a pair of side straps that engage one another for securely attaching the brassiere to a person's body, and a pair of shoulder straps, each strap being connected at a first end to a top of one cup and at an opposite second end to a top edge of one side strap, wherein the body portion has a front section located between the pair of cups, the front section including a pocket that is accessible through a slot formed in the front section; and a fragrant article that is removably disposed within an interior of the pocket, the fragrant article having a fragrance associated therewith that provides a scent wherein the fragrant article is formed of a material that absorbs a liquid and includes a liquid fragrance that impregnates the material so as to provide the scent when the fragrant article is worn with the brassiere.

2. A fragrant brassiere comprising:

a body portion having a pair of cups, a pair of side straps that engage one another for securely attaching the brassiere to a person's body, and a pair of shoulder straps, each strap being connected at a first end to a top of one cup and at an opposite second end to a top edge of one side strap, wherein the body portion has a front section located between the pair of cups, the front section including a pocket that is accessible through a slot formed in the front section; and a fragrant article that is removably disposed within an interior of the pocket, the fragrant article having a fragrance associated therewith that provides a scent; wherein the fragrant article is formed of a solid material and has a recessed channel formed therein, the fragrant article further including an insert that is disposed within the recessed channel.

3. A fragrant brassiere comprising:

a body portion having a pair of cups, a pair of side straps that engage one another for securely attaching the brassiere to a person's body, and a pair of shoulder straps, each strap being connected at a first end to a top of one cup and at an opposite second end to a top edge of one side strap, wherein the body portion has a front section located between the pair of cups, the front section including a pocket that is accessible through a slot formed in the front section; and a fragrant article that is removably disposed within an interior of the pocket, the fragrant article having a fragrance associated therewith that provides a scent; wherein the fragrant article is formed of a solid material and has a layer that is disposed along one surface of the fragrant article and contains odiferous molecules that are vaporized from a solid state under prescribed conditions, the layer being covered with a release cover, the cover being formed of a material that seals the freshness and scent of the solid material until removal of the cover.

4. The fragrant brassiere of claim 3, wherein the prescribed conditions include exposure of the solid material to atmosphere and exposure of the solid material to heat.

5. An article of intimate apparel comprising:

a brassiere including a body portion having a pair of cups, a pair of side straps that engage one another for securely attaching the brassiere to a person's body, and a pair of shoulder straps, each strap being connected at a first end to a top of one cup and at an opposite second end to a top edge of one side strap, wherein the body portion has a front section located between the pair of cups that includes a pocket that defines an interior storage space and is accessible through a slot formed in the front section, the pocket being configured for receiving at least one fragrant article that emits a scent, wherein the fragrant article is formed of a paper material, with a plurality of fragrant articles being detachably attached to one another along perforated lines.

6. The article of claim 5, further including a pouch that is attached to one strap of the brassiere wherein the at least one fragrant article is contained within the pouch in a sealed package that contains odiferous molecules, the fragrant article for placement in the pocket when the brassiere is worn by a user, the fragrant article having a fragrance associated therewith, defined by the odiferous molecules, that provides the scent.

7. The article of claim 6, wherein the package includes an opening to permit access to and removal of the fragrant article and a peelable cover that seals the opening to ensure freshness and maintain a liquid fragrance in an interior of the package, the cover being a resealable cover in that after each time the cover is lifted to expose the opening, it can be resealed to a side of the package.

8. The article of claim 7, wherein the cover includes a first foil section that is disposed over the opening when the cover is in a closed position and a surrounding section that includes an adhesive material to cause the cover to seal to the package around the opening.

9. The article of claim 7, wherein a first end of the cover is fixedly attached to the package with a hinge being formed near the first end to permit the cover to be lifted to expose the opening and a second end of the cover includes a peel tab to assist the user in lifting the cover to expose the opening and remove the fragrant article.

10. The article of claim 6, wherein the fragrance comprises a liquid perfume.

11. The article of claim 6, wherein the package is formed of a foil material.

12. The article of claim 5, wherein the opening comprises a bottom slot that is located proximate a bottom edge of the front section and the interior compartment is located above the bottom slot.

13. The article of claim 5, wherein the opening comprises a top slot that is located proximate a top edge of the front section and the interior compartment is located below the top slot.

14. The article of claim 5, wherein the opening comprises a side opening that is located proximate one of the cups and the interior compartment is closed along top and bottom edges of the front section.

15. The article of claim 5, wherein the front section has a generally triangular shape and the fragrant article has a complementary triangular shape with rounded edges.

16. The article of claim 6, wherein the pouch has a cinch element to close an open end thereof and includes space to include advertising indicia.

* * * * *